US007775463B2

(12) United States Patent
Abe et al.

(10) Patent No.: US 7,775,463 B2
(45) Date of Patent: Aug. 17, 2010

(54) ELECTROMAGNETIC FUEL INJECTION VALVE

(75) Inventors: Motoyuki Abe, Hitachinaka (JP); Masahiko Hayatani, Hitachinaka (JP); Tohru Ishikawa, Kitaibaragi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/776,761

(22) Filed: Jul. 12, 2007

(65) Prior Publication Data

US 2008/0011886 A1 Jan. 17, 2008

(30) Foreign Application Priority Data

Jul. 13, 2006 (JP) ..... 2006-192289

(51) Int. Cl.
*F02M 51/00* (2006.01)
*F02D 1/06* (2006.01)
*F02D 7/00* (2006.01)

(52) U.S. Cl. ..... 239/585.1; 239/585.2; 239/585.4; 239/585.5; 239/5

(58) Field of Classification Search ... 239/585.1–585.5, 239/88–91, 533.2–533.15
See application file for complete search history.

(56) References Cited

U.S. PATENT DOCUMENTS 4,610,080 A * 9/1986 Hensley ..... 29/602.1
5,428,883 A * 7/1995 Stieglitz ..... 29/602.1
6,076,802 A * 6/2000 Maier ..... 251/129.21
6,299,079 B1 * 10/2001 Noller et al. ..... 239/600
6,364,220 B2 * 4/2002 Willke et al. ..... 239/585.1
7,048,253 B2 * 5/2006 Stier ..... 251/129.21
2001/0002681 A1 6/2001 Willke et al.

FOREIGN PATENT DOCUMENTS

JP 10-318079 A 12/1998
JP 2001-504916 A 4/2001
JP 2002-48032 A 2/2002
JP 2002-206468 A 7/2002
JP 2004285923 A * 10/2004
JP 2005-195015 A 7/2005
JP 2005-233048 A 9/2005
JP 2005-282576 A 10/2005
JP 2006-22757 A 1/2006

OTHER PUBLICATIONS

Chinese Office Action dated Jul. 1, 2008.

* cited by examiner

*Primary Examiner*—Len Tran
*Assistant Examiner*—James S Hogan
(74) *Attorney, Agent, or Firm*—Crowell & Moring LLP

(57) ABSTRACT

In an injector used for an internal combustion engine, a favorable magnetic attraction force is obtained to reduce a controllable minimum injection amount of a fuel injection amount. In a fuel injection valve in which a fixed core and a moving element is contained inside a pipe-shaped member, and a coil and a yoke are provided on an outer side thereof, a space for placing the coil is placed so that an inner circumference length in a vertical section of the space becomes smaller than an outside diameter of the yoke, or a height of the space in an axial direction of the fixed core becomes smaller than a diameter of the fixed core.

16 Claims, 5 Drawing Sheets

ELECTROMAGNETIC FUEL INJECTION VALVE

BACKGROUND OF THE INVENTION (1) Field of the Invention

The present invention relates to an electromagnetic fuel injection valve which is a fuel injection valve used for an internal combustion engine, and performs opening and closing movement of a valve body by supplying magnetic flux to an magnetic passage including an anchor of a moving element and a fixed core by passing a current to a coil, and generating a magnetic attraction force in a magnetic attraction gap between an anchor end surface of the moving element and a fixed core end surface to attract the moving element to the fixed core side, and the invention concretely relates to a fuel injection valve in which a fixed core is fixed to an inside of a metal pipe, the moving element is disposed to be attracted to and separated from the fixed core in the metal pipe, and the coil and a yoke are fitted to an outer side of the metal pipe to supply magnetic flux to the anchor of the moving element and the fixed core.

(2) Description of Related Art

JP-A-10-318079 discloses an art of providing a fuel injection valve having high manufacturing efficiency by using a pipe-shaped valve housing containing a valve body and a magnetic core and unmagnetizing a part of the valve housing.

In the above described prior art, the coil height which is the dimension in the axial direction of the coil wound on the bobbin becomes large, and the magnetic passage becomes long. Therefore, the above described prior art has the problem of being unable to obtain a sufficient amount of magnetic flux generating in a magnetic attraction gap between a fixed core and an anchor by the magnetomotive force supplied to the magnetic passage in spite of the size of the coil.

BRIEF SUMMARY OF THE INVENTION

An object of the present invention is to decrease magnetic resistance in a magnetic passage so as to be able to obtain more magnetic flux passing through a magnetic attraction gap with a small magnetomotive force and convert the magnetomotive force into a magnetic attraction force effectively.

In order to attain the above-described object, the present invention is achieved by forming around a magnetic attraction gap a short magnetic passage, which is formed by a fixed core and an anchor disposed inside a metal pipe and an upper, lower and outer circumference yoke portions disposed on an outer side of the metal pipe.

According to the present invention constituted as above, an electromagnetic fuel injection valve with favorable responsiveness, which can obtain a large magnetic attraction force with a small electromagnetic coil device and magnetic passage constitution, can be provided.

Other objects, features and advantages of the invention will become apparent from the following description of the embodiments of the invention taken in conjunction with the accompanying drawings.

DETAILED DESCRIPTION OF THE INVENTION

An entire constitution of an embodiment will be described hereinafter by using FIGS. 1 and 2.

Figure 1:
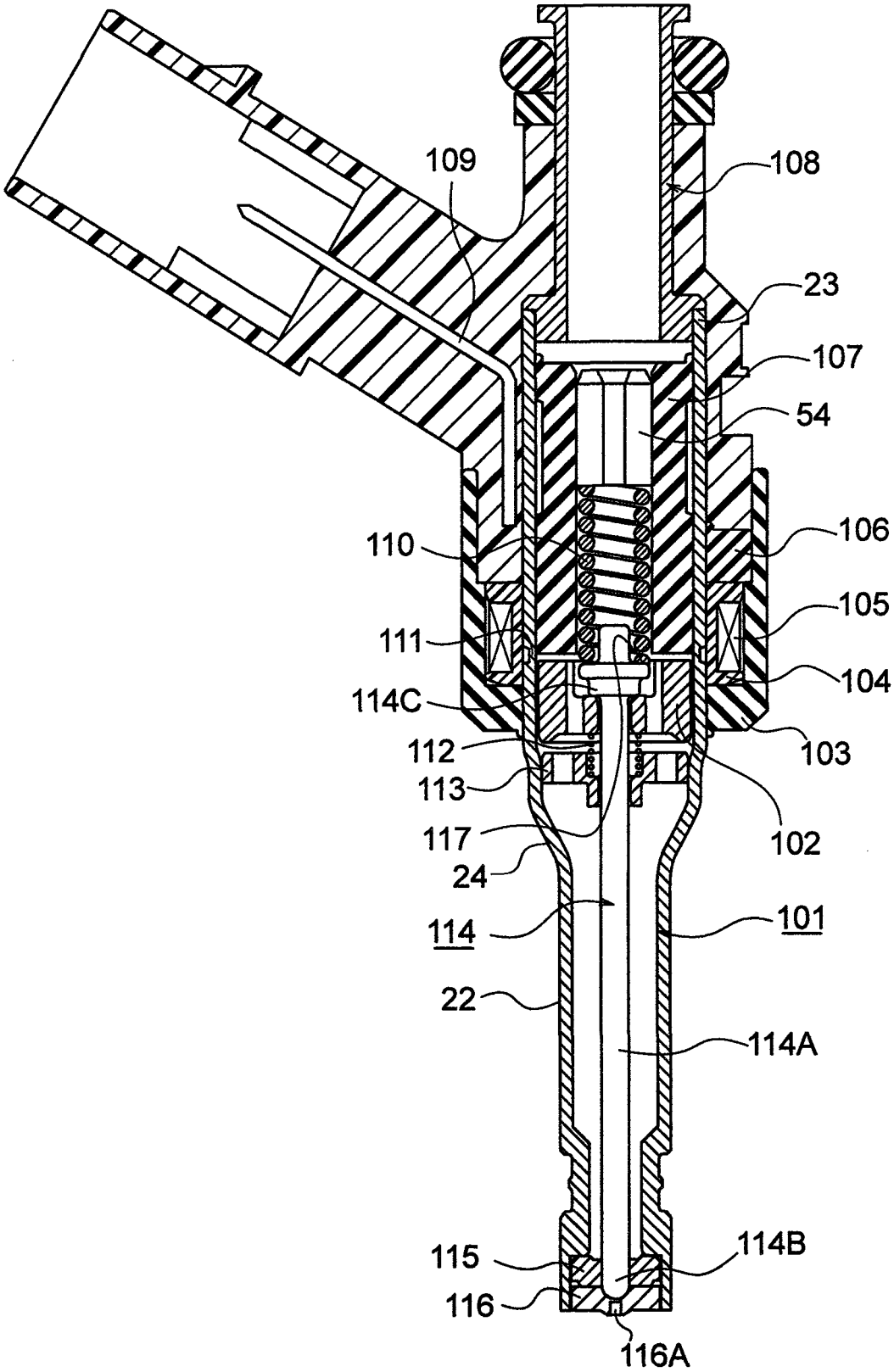
FIG. 1 is a sectional view showing an overview of a fuel injection valve in which the present invention is carried out.

FIG. 1 is a vertical sectional view of an electromagnetic fuel injection valve of the embodiment. FIG. 2 is a partially enlarged view of FIG. 1, and shows a constitution of a magnetic passage in the electromagnetic fuel injection valve of the embodiment.

A constitution of the electromagnetic fuel injection valve of the embodiment will be described hereinafter with reference to FIGS. 1 and 2.

A nozzle pipe 101 of a metal material includes a small-diameter cylindrical part 22 with a small diameter and a large-diameter cylindrical part 23 with a large diameter, and both the parts are connected by a conical sectional part 24.

A nozzle body is formed at a tip portion of the small-diameter cylindrical part 22. In concrete, a guide member 115 which guides a fuel to a center, and an orifice plate 116 including a fuel injection port 116A are stacked in this order and inserted into a cylindrical portion formed inside a tip end portion of the small-diameter cylindrical part, and are fixed to the cylindrical portion by welding at an periphery of the orifice plate 116.

The guide member 115 guides an outer periphery of a plunger portion 114A of a later-described moving element 114 or a valve body 114B provided at a tip end of the plunger portion 114A, and also functions as a fuel guide which guides the fuel to an inside from an outside in a radial direction.

In the orifice plate 116, a conical valve seat is formed on a side facing the guide member 115. The valve body 114B provided at a tip end of the plunger portion 114A abuts on the valve seat 39, and guides and shuts off the flow of the fuel to and from the fuel injection port 116A.

A groove is formed on an outer periphery of the nozzle body, and a seal member represented by a chip seal of a resin material or a gasket with rubber seized to a periphery of a metal is fitted in the groove.

In a lower end portion of an inner periphery of the large-diameter cylindrical part 23 of the nozzle pipe 101 of a metal material, a plunger guide 113 which guides the plunger portion 114A of the moving element 114 is fixed to a contracted portion 25 of the large-diameter cylindrical part 23 by press-fitting.

The plunger guide 113 is provided with a guide hole 127, which guides the plunger portion 114A, in a center, and a plurality of fuel passages 126 are bored around the guide hole 127.

Further, a recessed portion is formed on a central top surface by extrusion. A spring 112 is held in the recessed portion.

A protruded portion corresponding to the recessed portion is formed on a central lower surface of the plunger guide 113 by extrusion, and a guide hole for the plunger portion 114A is provided in a center of the protruded portion.

Thus, the slim and long plunger portion 114A is guided by the guide hole 127 of the plunger guide 113 and the guide hole of the guide member 115 so as to perform straight reciprocating motion.

Since the nozzle pipe 101 of the metal material is integrally formed with the same member from the tip end portion to the rear end portion as above, the components are easily managed and favorable assembling operability is provided.

A head portion 114C having stepped portions 129 and 133 having larger outside diameters than a diameter of the plunger portion 114A is provided at an end portion opposite from the end portion provided with the valve body 114B, of the plunger portion 114A. A seat surface for a spring 110 is provided on an upper end surface of the stepped portion 129, and a projection 131 for guiding the spring is formed in a center.

The moving element 114 has an anchor 102 including in a center a through-hole through which the plunger portion 114A penetrates. In the anchor 102, a recessed portion 112A for supporting a spring is formed in a center of a surface on the side facing the plunger guide 113, and the spring 112 is held between the recessed portion 125 of the plunger guide 113 and the recessed portion 112A.

Since a diameter of a through hole 128 is smaller than a diameter of the stepped portion 133 of the head portion 114C, the lower end surface of the inner periphery of the stepped portion 133 of the head portion 114C of the plunger portion 114A abuts on a bottom surface of a recessed portion 123 formed on the upper surface of the anchor 102 held by the spring 112, and both of them are engaged with each other, under the action of the biasing force of the spring 110 which presses the plunger portion 114A to the valve seat of the orifice plate 116 or the gravity.

Thereby, with respect to upward movement of the anchor 102 against the biasing force of the spring 112 or the gravity, or downward movement of the plunger portion 114A along the biasing force of the spring 112 or the gravity, both of them move together in cooperation.

However, when the force which moves the plunger portion 114A upward irrespective of the biasing force of the spring 112 or the gravity, or the force which moves the anchor 102 downward independently acts on both of them separately, both of them are to move in the separate directions.

At this time, a fluid film which exists in a very small gap of 5 to 15 micrometers between the outer peripheral surface of the plunger portion 114A and the inner peripheral surface of the anchor 102 in a portion of the through-hole 128 generates friction to the movements in the different directions of both of them, and suppresses the movements of both of them. Specifically, brake is applied to rapid displacements of both of them. The fluid film hardly shows resistance to a slow movement. Thus, such instant movements in the opposite directions of both of them are attenuated in a short time.

Here, the center position of the anchor 102 is not held between the inner peripheral surface of the large-diameter cylindrical portion 23 and the outer peripheral surface of the anchor 102, but by the inner peripheral surface of the through hole 128 of the anchor 102 and the outer peripheral surface of the plunger portion 114A. The outer peripheral surface of the plunger portion 114A functions as the guide when the anchor 102 solely moves in the axial direction.

The lower end surface of the anchor 102 faces the upper end surface of the plunger guide 113, but the spring 112 is interposed therebetween, and therefore, both of them are not in contact with each other.

A side gap is provided between the outer peripheral surface of the anchor 102 and the inner peripheral surface of the large-diameter cylindrical part 23 of the nozzle pipe 101 of the metal material. The side gap allows the movement in the axial direction of the anchor 102, and therefore, is made, for example, about 0.1 millimeters which is larger than the very small gap of 5 to 15 micrometers formed between the outer peripheral surface of the plunger portion 114A and the inner peripheral surface of the anchor 102 in the portion of the through-hole 128. If the side gap is made too large, the magnetic resistance becomes large, and therefore, the gap is determined in view of a tradeoff with magnetic resistance.

A fixed core 107 is press-fitted into the inner peripheral portion of the large-diameter cylindrical part 23 of the nozzle pipe 101 of the metal material, and a fuel introducing pipe 108 is press-fitted into its upper end portion and is joined to the upper end portion by welding at the press-fitted and contact position of the large-diameter cylindrical part 23 of the nozzle pipe 101 and the fuel introducing pipe part 108. By the welding joint, a fuel leakage gap which is formed between the inside of the large-diameter cylindrical part 23 of the nozzle pipe 101 of the metal material and external air is sealed.

The fuel introducing pipe 108 and the fixed core 107 are provided with a through-hole having a diameter slightly larger than the diameter of the head portion 114C of the plunger portion 114A in a center.

The head portion 114C of the plunger portion 114A is inserted through an inner periphery of a lower end portion of the through-hole of the fixed core 107 in a non-contact state, and a gap having about the same dimension as the above described side gap is given as a gap between an inner peripheral lower end edge 132 of the through-hole of the fixed core 107 and an outer peripheral edge portion 134 of the stepped portion 133 of the head portion 114C. This is for reducing leakage of a magnetic flux to the plunger portion 114A from the fixed core 107 as much as possible by making the gap larger than the space (about 40 to 100 micrometers) from an inner peripheral edge portion 135 of the anchor 102.

A lower end of the spring 110 for setting an initial load abuts on a spring receiving seat 117 which is formed on the upper end surface of the stepped portion 133 provided at the head portion 114C of the plunger portion 114A, and the other end of the spring 110 is received by an adjuster 54 press-fitted in the inside of the through-hole of the fixed core 107, whereby the spring 110 is fixed between the head portion 114C and the adjuster 54.

By adjusting the fixed position of the adjuster 54, the initial load by which the spring 110 presses the plunger 11 against the valve seat 39 can be adjusted.

As for adjustment of the stroke of the anchor 102, an electromagnetic coil (104, 105) and a yoke (103, 106) are fitted to the outer periphery of the large-diameter cylindrical part 23 of the nozzle pipe 101. Thereafter, in the state in which the anchor 102 is set inside the large-diameter cylindrical part 23 of the nozzle pipe 101, and the plunger portion 114A is inserted through the anchor 102, the plunger portion 114A is pressed down to the valve closing position by a jig, and while the stroke of the moving element 114 when the coil 105 is energized is being detected, the press-fitting position of the fixed core 107 is determined, whereby, the stroke of the moving element 114 can be adjusted to an optional position.

Figure 2:
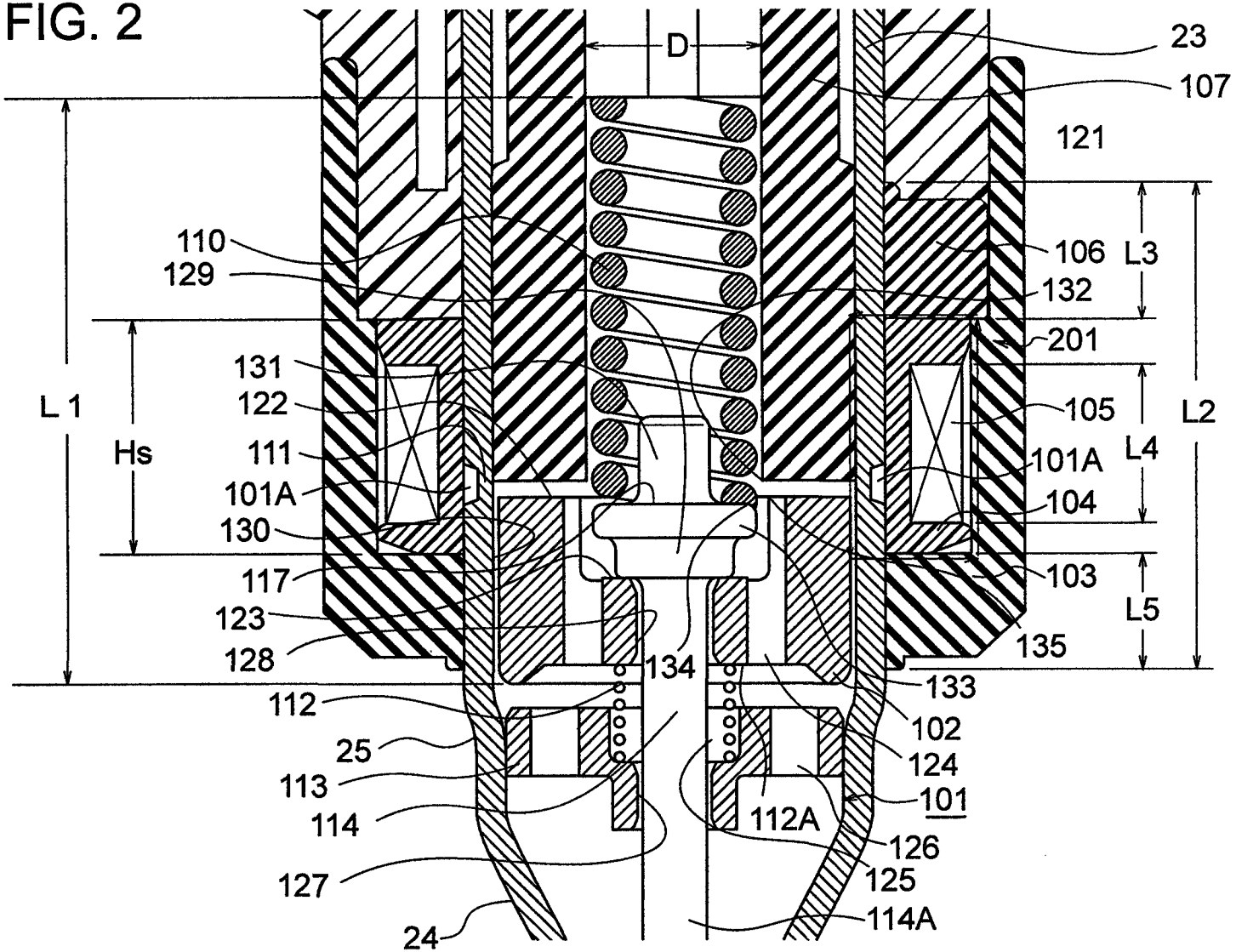
FIG. 2 is a sectional view enlarging a magnetic passage portion of the fuel injection valve in which the present invention is carried out.

As shown in FIGS. 1 and 2, in the state in which the initial load of the initial load setting spring 110 is adjusted, the lower end surface of the fixed core 107 is constituted to face an upper end surface 122 of the anchor 102 of the moving element 114 with a magnetic attraction gap of about 40 to 100 micrometers (exaggerated in the drawings) from the upper end surface 122. The outside diameter of the anchor 102 is only slightly (about 0.1 millimeters) smaller than the outside diameter of the fixed core 107. The inside diameter of the through-hole 128 located at the center of the anchor 102 is slightly larger than the outside diameters of the plunger portion 114A of the moving element 114 and the valve body. The inside diameter of the through-hole of the fixed core 107 is slightly larger than the outside diameter of the head portion 114C. The outside diameter of the head portion 114C is larger than the inside diameter of the through-hole 128 of the anchor 102.

Thereby, while the magnetic passage area in the magnetic attraction gap is sufficiently secured, engagement allowance in the axial direction of the lower end surface of the head portion 114C of the plunger portion 114A and the bottom surface of the recessed portion 123 of the anchor 102 is secured.

A cup-shaped yoke 103 and a ring-shaped upper yoke 106 provided to close an opening at an open side of the cup-shaped yoke 103 are fixed to an outer periphery of the large-diameter cylindrical part 23 of the nozzle pipe 101 of the metal material.

A through-hole is provided in the center of the bottom portion of the cup-shaped yoke 103, and the large-diameter cylindrical part 23 of the nozzle pipe 101 of the metal material is inserted through the through-hole.

An outer peripheral wall portion of the cup-shaped yoke 103 forms an outer peripheral yoke portion facing the outer peripheral surface of the large-diameter cylindrical part 23 of the nozzle pipe 101 of the metal material.

An outer periphery of the ring-shaped upper yoke 106 is press-fitted into an inner periphery of the cup-shaped yoke 103.

The ring-shaped or cylindrical magnetic coil 105 is disposed in the cylindrical space formed by the cup-shaped yoke 103 and the ring-shaped upper yoke 106.

The electromagnetic coil 105 is constituted of a ring-shaped coil bobbin 104 having a groove U-shaped in section which is opened outward in the radial direction, and the ring-shaped coil 105 formed of a copper wire wound in the groove.

An electric magnetic coil device is constituted of the bobbin 104, the coil 105, the cup-shaped yoke 103 and the upper yoke 106.

A conductor 109 having rigidity is fixed to a wind starting end portion and a wind finishing end portion of the coil 105, and the conductor 109 is drawn out from a through-hole provided in the upper yoke 106.

The conductor 109 and the fuel introducing pipe 108 and the outer periphery of the large-diameter part 23 of the nozzle pipe 101 are molded by mold with injecting an insulating resin on an upper portion of the upper yoke 106 on the inner periphery of the upper end opening of the cup-shaped yoke 103, and are covered with a resin molded body 121.

Thus, a troidal magnetic passage shown by the arrow 201 is formed around the electromagnetic coil (104, 105).

A plug which supplies electric power from a battery power supply is connected to a connector formed at a tip end portion of the conductor 43C, and energization and non-energization are controlled by a controller not shown.

During energization of the coil 105, a magnetic attraction force occurs between the anchor 102 of the moving element 114 and the fixed core 107 in a magnetic gap Ga by a magnetic flux passing through the magnetic passage 201, and the anchor 102 moves upward by being attracted with a force exceeding the set load of the spring 110. At this time, the anchor 102 is engaged with the head portion 114C of the plunger, moves upward together with the plunger portion 114A, and moves until the upper end surface of the anchor 102 collides with the lower end surface of the fixed core 107.

As a result, the valve body 114B at the tip end of the plunger portion 114A separates from the valve seat, a fuel passes through the fuel passage and spouts into a combustion chamber from a plurality of injection ports 116A.

When energization of the electromagnetic coil 105 is shut off, the magnetic flux in the magnetic passage 201 disappears, and a magnetic attraction force in the magnetic attraction gap also disappears.

In this state, the spring force of the spring 110 for setting an initial load, which presses the head portion 114C of the plunger portion 114A in the opposite direction, surpasses the force of the spring 112 and acts on the entire moving element 114 (the anchor 102, the plunger portion 114A).

As a result, the anchor 102 of the moving element 114 which loses the magnetic attraction force is pushed back to the closed position in which the valve body 114B contacts the valve seat by the spring force of the spring 110.

At this time, the stepped portion 129 of the head portion 114C abuts on the bottom surface of the recessed portion 117 of the anchor 102 and surpasses the force of the spring 112 to move the anchor 102 to the plunger guide 113 side.

When the valve body 114B collides with the valve seat forcibly, the plunger portion 114A rebounds in a direction to compress the spring 110.

However, the anchor 102 is separate from the plunger portion 114A, and therefore, the plunger portion 114A separates from the anchor 102 and is to move in the opposite direction from the movement of the anchor 102.

At this time, friction by a fluid occurs between the outer periphery of the plunger portion 114A and the inner periphery of the anchor 102, and the energy of the rebounding plunger 114A is absorbed by the inertial mass of the anchor 102 which is to move still in the opposite direction (valve closing direction) by the inertia force.

At the time of rebounding, the anchor 102 having a large inertial mass is separated from the plunger 11, and the rebounding energy itself becomes small.

The anchor 102 which absorbs the rebounding energy of the plunger portion 114A decreases in its own inertia force correspondingly. Therefore, the energy which compresses the spring 112 decreases, the repulsive force of the spring 112 decreases, and the phenomenon in which the plunger portion 114A is moved in the valve opening direction by the rebounding phenomenon of the anchor 102 itself hardly occurs.

Thus, rebound of the plunger 11 is suppressed to the minimum, and a so-called secondary injection phenomenon in which the valve opens after energization of the electromagnetic coil (104, 105) is cut off and the fuel is injected unintentionally is suppressed.

Especially in this embodiment, a groove 101A is provided on the outer periphery of the portion where the lower end surface of the fixed core 107 is located. The groove 101A is for decreasing the passage sectional area of the large-diameter cylindrical part 23 to be a leakage magnetic flux passage in order to make it difficult to leak the magnetic flux flowing between the fixed core 107 and the anchor 102. The groove is located around the magnetic attraction gap of 40 to 100 micrometers, and is constituted to have a width in the axial direction of 500 micrometers, and a thickness of about ½ of the wall thickness of 750 micrometers of the large-diameter cylindrical part 23 of the nozzle pipe 101. The thickness of the magnetism restriction portion 111 is about 400 micrometers.

The lower end surface of the fixed core 107 is constituted to be located in a substantially center of the groove 101A so that the upper end surface of the anchor 102 is located in the width of the axial direction of the ring-shaped groove 101A even when the plunger portion 114A is in the lowermost position (valve closed position).

The anchor 102 is formed of magnetic stainless steel suitable for forging with favorable workability, and at least the end surface which collides with the fixed core 107 and the surface of its periphery are plated with chrome (Cr) or Ni (nickel).

Embodiment 1

A fuel injection valve is required to be able to respond to a valve opening signal which is inputted quickly and open or close the valve. Specifically, from the viewpoint of making the minimum controllable injection amount (minimum injection amount) smaller, it is also important to reduce a delay time (valve opening delay time) after a valve opening pulse signal rises until the actual valve open state is established, and a delay time (valve closing delay time) after the valve opening pulse signal terminates until the actual valve closed state is established. Above all, reduction of the valve closing delay time is known to be effective for reduction in the minimum injection amount. Therefore, the set load of the spring 110 which applies the force to move the valve body from the open state to the closed state is desired to be large. Specifically, if the set load of the spring 110 is large, the force which drives the valve body 114B becomes large, and easily performs valve closing against the remaining electromagnetic force and the fluid resistance force, and can reduce the valve closing delay time. In order to take a large set load of the spring 110 like this, and in order that the valve body 114B performs valve opening against the large spring set load and keeps the open state, a large magnetic attraction force is required between the fixed core 107 and the anchor 102. Therefore, in order to improve responsiveness for valve switching, and reduce the minimum injection amount, a sufficiently large magnetic attraction force needs to be obtained.

The magnetic attraction force of the attraction surface between the fixed core 107 and the anchor 102 is determined by the magnetic flux density which penetrates through the anchor 102 and the fixed core 107 in the attracting direction, and the attraction area. Especially because the magnetic attraction force becomes large proportionately with the square of the magnetic flux density, enhancement in the magnetic flux density in the attraction surface is necessary.

For this, the magnetic flux occurring in the magnetic passage needs to be efficiently guided to the attraction surface. The spring receiving seat 117 of the valve body 114B is placed on the anchor side from the end surface of the fixed core 107, for example, as shown in FIG. 1, and this is for preventing reduction in magnetic flux density occurring to the attraction surface of the fixed core 107 as a result of the magnetic flux leaking to the spring receiving seat 117 of the valve body 114B from the inside diameter side of the fixed core 107. The valve body 114B has the function of performing opening and closing for the fuel by colliding with the valve seat, and therefore, a relatively hard material is frequently used for the valve body 114B. As steel or stainless steel with high hardness, those having a martensitic structure are frequently used, and the martensitic structure has a high magnetic permeability. Accordingly, when the spring receiving seat 117 has magnetism, the receiving seat 117 is placed on the anchor side from the end surface of the fixed core 107, and placing the receiving seat for the spring so as not to be the leakage route of the magnetic flux between the fixed core 107 and the anchor 102 contribute to enhancement in efficiency of the magnetic passage.

In the structure in which sealing of the fuel is facilitated by constituting the anchor 102, the fixed core 107 and the valve body in one pipe-shaped member (nozzle pipe 101) to be able to manufacture the fuel injection valve to be compact and simple as shown in FIG. 1, reduction in the attraction force is difficult to avoid due to the existence of the magnetic flux passing in the nozzle pipe 101 which is a magnetic substance. As the method for avoiding reduction in the attraction force, the method of reducing the amount of magnetic flux leaking to the nozzle pipe 101 from the attraction surface by using a material with small saturation magnetic flux density (about 1.0 to 1.6 T) as compared with the member used for the fixed core 107 and the anchor 102 for the material of the nozzle pipe 101, or the like is conceivable. For example, with use of martensitic stainless steel having a small carbon amount of 0.2% by weight or less, the characteristic can be easily satisfied, and relatively high strength can be obtained in terms of strength. However, with this method, portions with small saturation magnetic flux density occurs in the main magnetic passage, and the magnetic flux is applied to the fixed core, the attraction gap, the anchor and the yoke across the portions with small saturation magnetic flux density. Therefore, the magnetic resistance of the magnetic passage becomes large, and the magnetic attraction force generated in the magnetic attraction gap cannot be made large.

Alternatively, the method of non-magnetizing a part of the nozzle pipe 101 and locating the non-magnetized range around the magnetic attraction gap formed between the attraction surfaces 202 and 203 is known. However, in order to non-magnetize a part of the nozzle pipe 101, special heat treatment is required to be the factor that increases cost, and restriction occurs to the material used for the nozzle pipe 101.

Especially in the fuel injection valve which is used in a cylinder direct injection type gasoline internal combustion engine used at a high pressure, the above described pipe needs to have strength sufficiently withstanding the fuel pressure, as compared with the fuel injection valve used in a port injection type gasoline internal combustion engine, and therefore, the above described pipe needs to have a sufficient thickness. When a partial non-magnetization is not performed for the pipe-shaped member, if the pipe-shaped member is made of a magnetic material, the ratio of the magnetic flux, which should be occurs between the fixed core and the anchor, leaking to the pipe-shaped member increases, and it becomes difficult to obtain a sufficient magnetic attraction force.

As shown in FIG. 2, in this embodiment, the ring-shaped groove 101A is provided on the outer circumference of the nozzle pipe 101 at the position corresponding to the circumference of the magnetic attraction gap formed between the attraction surfaces 202 and 203, and the sectional area of the nozzle pipe 101 is made small at the groove portion to provide the magnetism restriction portion 111. The magnetism restriction portion 111 has the characteristics which cause magnetic saturation with a small amount of magnetic flux as compared with the other main magnetic passages, and shows magnetically infinite magnetic resistance, how much magnetic flux may be supplied after magnetic saturation. As a result, the magnetic restriction portion acts as the magnetic insulating portion, and can decrease the leakage magnetic flux from this portion. With this method, the nozzle pipe 101 can be constituted of a ferromagnetic material, and a portion with small saturation magnetic flux density does not exist in the main magnetic passage. Therefore, the main magnetic passage can be constituted of a material easily passing magnetic flux, as a result of which, a large amount of magnetic flux can be supplied to the magnetic attraction gap, and a large magnetic attraction force can be generated.

Figure 3A:
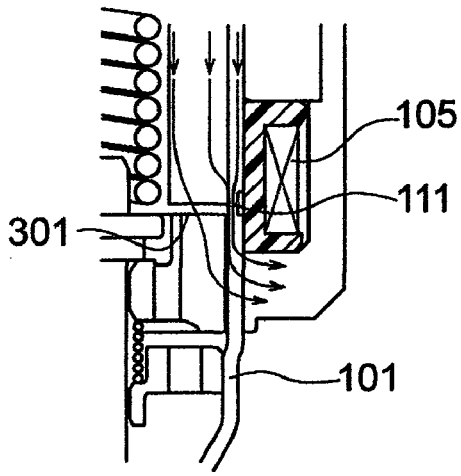
FIGS. 3A to 3C are schematic views explaining a flow of magnetic flux in the fuel injection valve of an embodiment illustrated in FIG. 2.
Figure 3B:
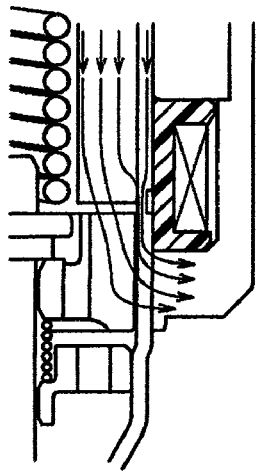
Figure 3C:
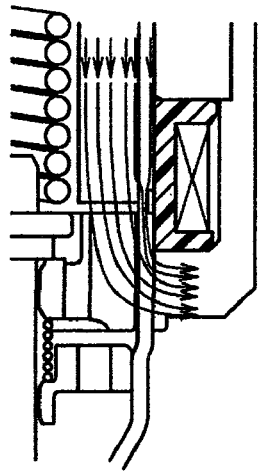

FIGS. 3A to 3C are schematic views showing states of magnetic lines of force occurring to the inside of the fuel injection valve of the embodiment shown in FIG. 2. The arrows shown in the drawings express the state of flow of the magnetic lines of force. FIGS. 3A to 3C show the states of the magnetic lines of force when the magnetomotive force changes from the small state to the large state. As shown in FIG. 3A, in the state in which the magnetomotive force is small, magnetic lines of force flow to the nozzle pipe 101 constituted of the magnetic material with small magnetic resistance rather than the attraction gap 301 with large magnetic resistance. As a result, the magnetic attraction force which occurs to the attraction gap 301 is in the small state. When the magnetomotive force is increased, the magnetic flux increases as shown in FIG. 3B, and the magnetic lines of force passing through the attraction gap 301 also increases. However, the magnetic restriction portion 111 provided at the nozzle pipe 101 does not reach magnetic saturation, and the amount of magnetic flux passing through the nozzle pipe is large. Therefore, the attraction force does not sufficiently occur. When the magnetomotive force is further increased, and the magnetism restriction portion 111 reaches magnetic saturation as shown in FIG. 3C, most of the magnetic flux occurring in the fixed core passes through the attraction gap 301, and the attraction force rapidly rises.

As above, even if the magnetomotive force is applied by energizing the coil 105, the magnetic attraction force does not easily becomes large. Like this, the method for securing sealing of the fuel by using the nozzle pipe 101 has the problem that a strong magnetic attraction force is difficult to obtain as compared with the case of sealing the fuel by using a separate non-magnetic member.

Therefore, in order to secure a sufficient magnetic attraction force with the magnetic flux leakage to the nozzle pipe 101 taken into consideration, a large magnetomotive force needs to be supplied by applying a large current to the coil 105, or a large magnetomotive force needs to be supplied by increasing the number of windings of the coil 105. Generally, in order to increase a current, it is necessary to make design by increasing the number of windings of the coil 105 since the burden on the drive circuit which drives the coil 105 increases. In the structure which seals the fuel by using the nozzle pipe 101, the gap from the yoke 103 is narrow depending on the thickness of the nozzle pipe 101. Therefore, the normal design method has been such that the length of the coil 105 in the injector axis direction is made long, the number of windings of the coil is increased to supply a sufficient magnetomotive force, and secure a magnetic attraction force.

However, when the fuel injection valve is designed according to such a design method, the number of windings of the coil is large, and therefore, inductance becomes large. Therefore, when non-magnetization of a part of the nozzle pipe 101 is difficult due to restriction in cost and restriction in the manufacturing method, not only the magnetomotive force which causes the leakage magnetic flux to the nozzle pipe 101 from the attraction surface becomes useless, but also inductance sometimes becomes large by the increased number of windings for obtaining a sufficient magnetic attraction force to reduce responsiveness. Therefore, in the structure containing the fixed core 107 and the anchor 102 in the nozzle pipe, efficient increase of the magnetic attraction force becomes an important object.

Figure 4:
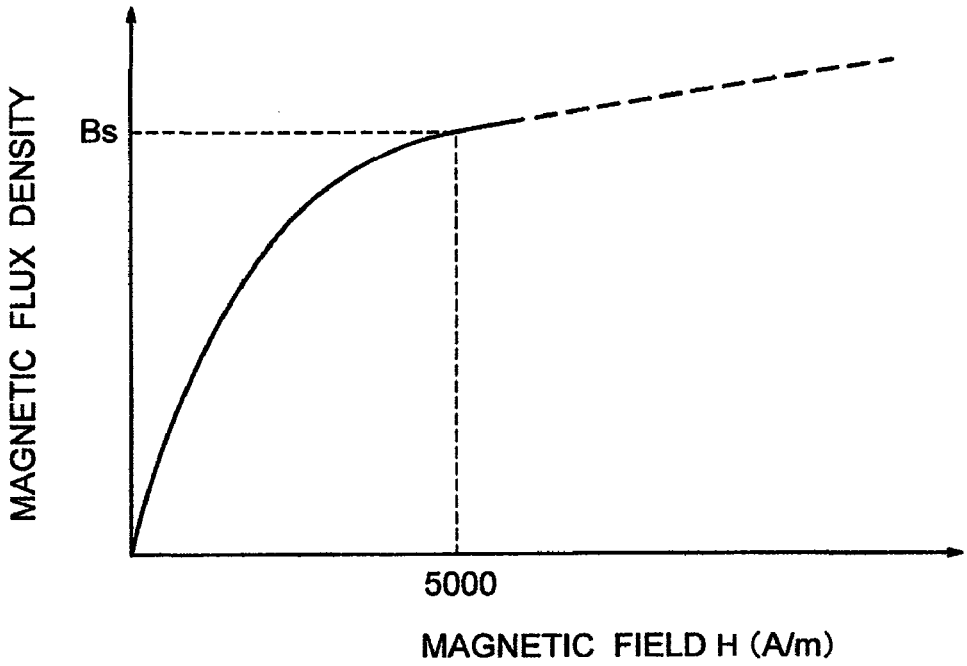
FIG. 4 is a graph showing characteristics of a magnetic material used for the fuel injection valve of the embodiment illustrated in FIG. 2.

Thus, the inventors paid attention to the magnetic characteristics a soft magnetic material (for example, electromagnetic stainless steel) used for the fixed core and the anchor of the fuel injection valve has, and has found out the method for increasing the magnetic attraction force. For the fixed core and the anchor of the fuel injection valve, soft magnetic electromagnetic stainless steel with a ferrite structure formed by adding chrome, silicon and aluminum to iron is frequently used. In such a soft magnetic material, the relationship of the magnetic flux density which generates with respect to the magnitude of the magnetic field applied from the outside is extremely nonlinear. As shown in FIG. 4, the actual magnetic flux density was higher than the magnetic flux density obtained with about 5 kA/m which is easy to measure by a general method, and it has been experimentally confirmed that by enhancing the external magnetic field, higher magnetic flux density is obtained. Specifically, when the soft magnetic electromagnetic stainless steel is used for the fixed core or the anchor, the magnetic flux density larger than the rated value (catalog value) which is set as the upper limit value of the saturation magnetic flux density which is generally measured by using a DC current can occur to the fixed core and the anchor. In the present invention, the selected magnetic material is used in a region (for example, three times to 10 times as large as the rated value, that is, 15 kA/m to 50 kA/m) of not less than the rated value of the normal saturation magnetic flux density of the selected magnetic material. The B/H characteristic was measured by an AC current because it cannot be measured by a DC current.

Accordingly, if the magnetic field applied from the outside is made sufficiently large, a larger magnetic attraction force than that has been conventionally considered is obtained. The magnetic field given from the outside is proportional to the magnetomotive force, but the method for making the magnetomotive force large as described above makes a considerable burden on the drive circuit due to increase in inductance and increase in current as in the conventional method.

Thus, in the present invention, the magnetic field from the outside is increased by shortening the length of the magnetic passage, and a large magnetic attraction force is obtained even with a small magnetomotive force. The magnetic field from the outside is proportional to the supplied magnetomotive force and is inversely proportional to the length of the magnetic passage, and therefore, if the length of the magnetic passage is short, a large magnetic field can be obtained with the same magnetomotive force. The magnetic passage is constituted of a route which makes one round, which is formed by the outer circumference yoke portion, the upper yoke portion, the fixed core, the attraction gap, the anchor, the side gap, the lower yoke portion and the outer circumference yoke portion, as shown by the arrow 201 in FIG. 2. The coil wound on the bobbin is housed in the space inside the magnetic passage in which the portions other than the side gap with a small clearance and the attraction surface are formed of the magnetic material, among them. The length of the arrow 201 showing the magnetic passage passing through the fixed core except for the magnetic passage (that is, the magnetic passage passing through the magnetism restriction 101A) of the inner circumferential surface portion of the nozzle pipe 101 which causes leakage magnetic flux and does not contribute to the attraction force, of the inner space is the inner circumference length of the magnetic passage which contributes to the attraction force in the electromagnetic fuel injection valve. In this embodiment, the total length of the inner circumference of the magnetic passage was made smaller than the outside diameter of the yoke 103 of the fuel injection valve, or the height Hs of the inner peripheral space in which the coil was housed was made smaller than the fixed core diameter, whereby the magnetic field was able to be made large without making the magnetomotive force large.

The diameter of the fixed core and the outside diameter of the yoke are the scales of the length relating to the sectional areas of the main portions of the magnetic passage. When the diameter of the fixed core becomes large, more magnetic flux is needed to obtain the equivalent magnetic flux density, and therefore, the coil needs to be driven with a larger magnetomotive force. When the yoke portion is magnetically saturated, the magnetic flux which can pass the fixed core decreases, and therefore, in order to obtain more magnetic flux, the yoke portion cannot help becoming large. The diameters of the fixed core and the yoke are the scale of the length expressing the sectional areas of the main magnetic passage like this, and are also the scales showing the magnitude of the magnetomotive force necessary for the generated magnetic flux to reach specified magnetic flux density.

Figure 5:
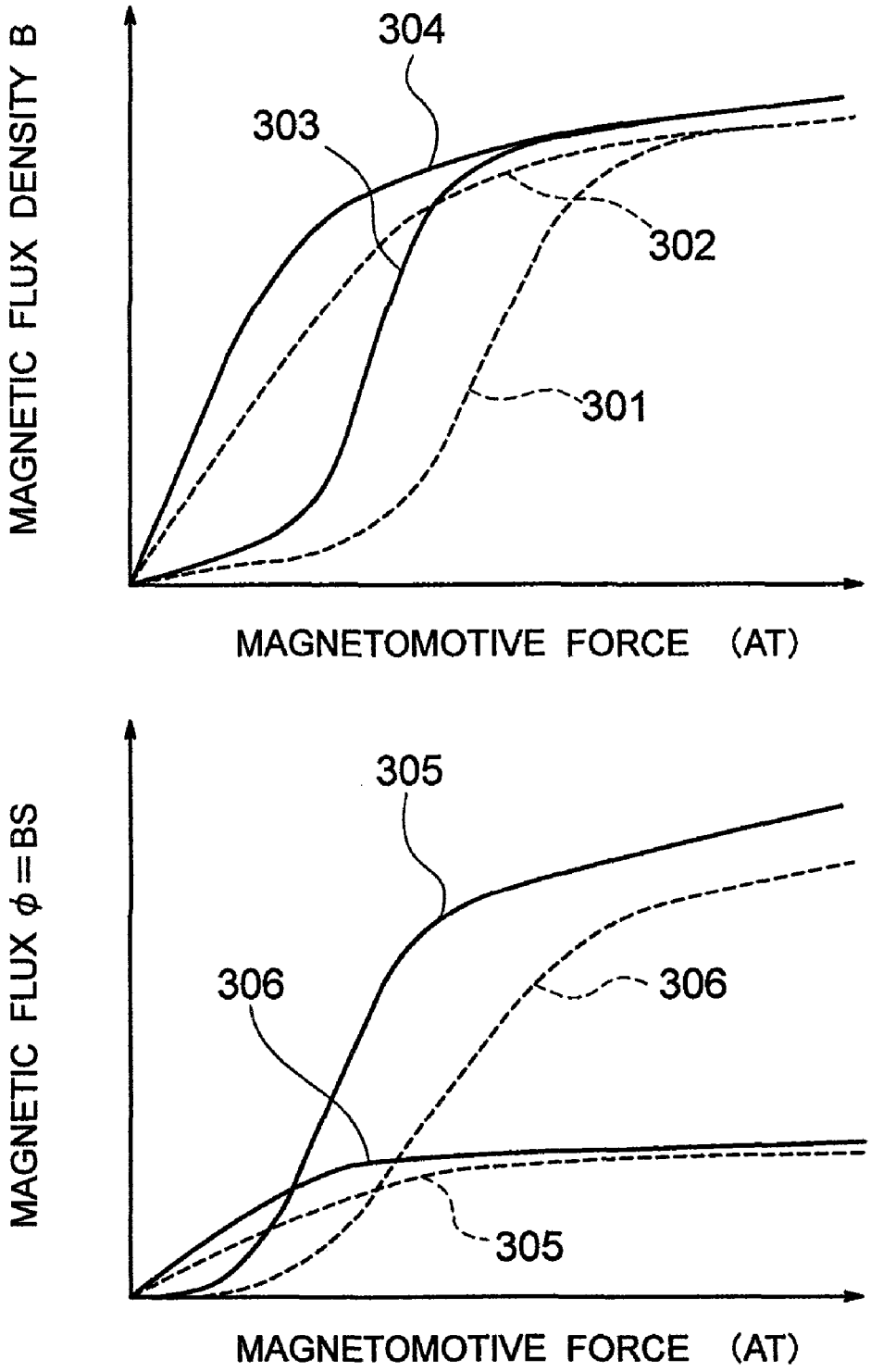
FIG. 5 is a graph drawing and comparing states of enhancement in magnetic flux and magnetic flux density with respect to a supplied magnetomotive force and comparing them between the fuel injection valve of the embodiment illustrated in FIG. 2 and a fuel injection valve according to a prior art.

The effect of reducing the inner circumference length of the magnetic passage is shown as in FIG. 5. FIG. 5-(*a*) is a graph showing the state of the magnetic flux density which occurs with respect to the supplied magnetomotive force, and the solid lines express the magnetic flux density according to the present invention, whereas the dotted lines express the magnetic flux density according to the prior art. When the magnetomotive force is supplied, magnetic flux density 302 of the magnetism restriction portion 111 of the nozzle pipe rises first in the prior art. The magnitude of the magnetic flux (the magnetic flux x area) at this time is shown as in FIG. 5-(*b*). The magnetism restriction portion 111 of the nozzle pipe is small in the passage sectional area as compared with the other magnetic passages, and therefore, even if the magnetic flux density is to increase, the absolute value of the magnetic flux does not become a specified value or more. When a magnetomotive force is further applied, the magnetic flux occurring to the magnetism restriction portion 111 of the nozzle pipe is close to the saturation magnetic flux density, and therefore, the degree of rise of the magnetic flux density 302 becomes low. Therefore, the magnetic flux hardly flows into the magnetism restriction portion 111, and magnetic flux density 301 which occurs to the fixed core and the attraction gap abruptly becomes large.

When the magnetic passage length is made short as in the present invention, a large magnetic field can be applied with respect to the same magnetomotive force, and therefore, the magnetic flux density which occurs to the attraction surfaces of the fixed core and the anchor can be increased. As a result, magnetic flux density 303 which occurs to the nozzle pipe and magnetic flux density 304 which occurs to the fixed core attraction surface can obtain high magnetic flux densities with a low magnetomotive force as in FIG. 5-(*a*). As for the absolute value of the magnetic flux, the profiles shown as magnetic flux 305 and magnetic flux 306 by the solid lines in FIG. 5-(*b*) are obtained. As a result, the magnetic flux density of the magnetism restriction portion 111 is made close to the saturation state early and the magnetic flux passing through the attraction surfaces of the fixed core and the anchor is increased early to be able to obtain a large magnetic attraction force early even with a small magnetomotive force.

Here, the opposed areas and the widths of the fixed core and the upper and lower yokes are the scales of the length relating to the sectional areas of the main portions of the magnetic passage. When the opposed area and the width become large, more magnetic flux is required for obtaining the equivalent magnetic flux density, and therefore, the coil needs to be driven with a larger magnetomotive force. When the yoke portion is magnetically saturated, the magnetic flux which can pass the fixed core decreases, and therefore, the yoke portion cannot help becoming large for obtaining more magnetic flux. Like this, the opposed areas and the widths of the fixed core and the upper and lower yokes, or the thickness of the outer circumference yoke portion are or is the scales or scale of the length expressing the sectional area of the main magnetic passage, and also the scales or scale showing the magnitude of the magnetomotive force necessary for the generated magnetic flux to reach specific magnetic flux density. Therefore, in this embodiment, in order to obtain the magnetic passage which is as short as possible to obtain necessary magnetic flux, the magnetic passage is devised as follows.

Figure 6:
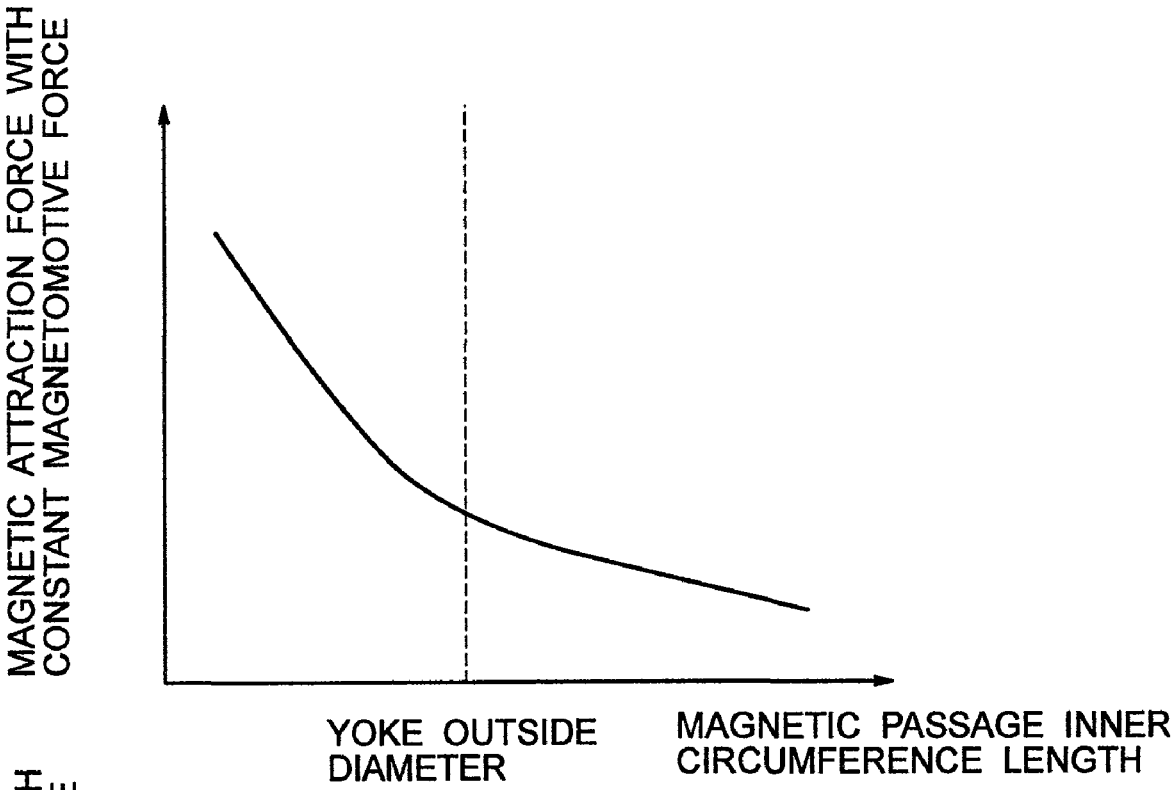
FIG. 6 is a graph comparing a length of a magnetic passage and a scale showing the magnitude of the magnetic passage in the fuel injection valve of the embodiment illustrated in FIG. 2.
Figure 6:
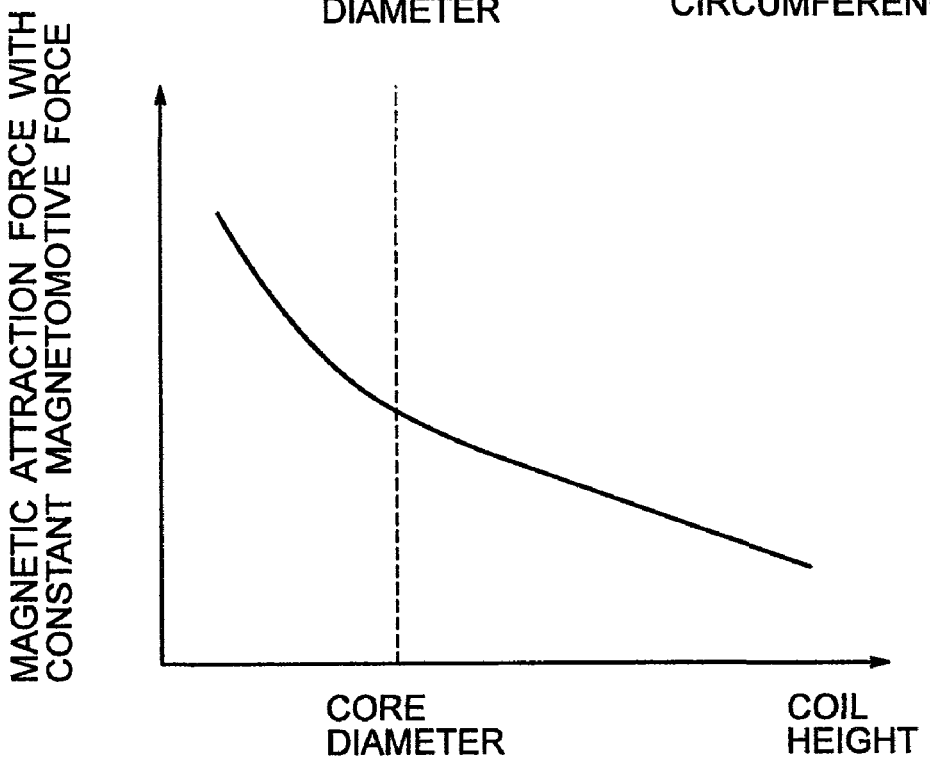

1. When the magnetic flux density which occurs to the attraction surface of the fixed core was examined with respect to the magnetic passage inner circumference length and the coil height Hs with the magnetomotive force set as constant, in the fuel injection valve of the type containing the fixed core and the anchor in the nozzle pipe, the results were as shown in FIG. 6. As the coil height Hs is lower (that is, as the dimension in the axial direction of the coil is smaller), and as the magnetic passage inner circumference length is shorter, the magnetic attraction force becomes larger. Especially under the condition that the magnetic passage inner circumference length is smaller than the yoke outside diameter, and under he condition that the coil height Hs is smaller than the fixed core diameter, the effects become remarkable.

2. Further, the magnetic passage is preferably constituted to be short so that an axial winding width L4 of the coil 105 becomes smaller than the sum of an axial dimension L3 of the upper yoke 106 facing the fixed core 107 and a dimension L5 of the lower yoke portion of the yoke 103 facing the anchor 102.

3. When the coil bobbin is taken into consideration, the magnetic passage is preferably constituted to be short so that the coil height Hs becomes smaller than the sum of the axial dimension L3 of the upper yoke 106 facing the fixed core 107, and the dimension L5 of the lower yoke portion of the yoke 103 facing the anchor 102.

4. At this time, the magnetic passage is preferably constituted to be short so that the axial winding width L4 of the coil 105, the axial dimension L3 of the upper yoke 106 facing the fixed core 107, and the dimension L5 of the lower yoke portion of the yoke 103 facing the anchor 102 become substantially the same dimensions.

5. If the axial dimension L3 of the upper yoke 106 facing the fixed core 107, and the dimension L5 of the lower yoke portion of the yoke 103 facing the anchor 102 are constituted to be about twice as large as the thickness of the outer circumference yoke, the magnetic passage sectional area becomes substantially the same in the entire circumference of the magnetic passage, and therefore, the magnetic passage without wastage can be obtained.

6. In order to make the magnetic passage as short as possible, the space for housing the coil needs to be made small. In order to make the space for housing the coil small, the thickness of the bobbin on which the coil is wound is made sufficiently small. If the thickness between the bobbin and the coil can be within 25% with respect to the thickness in the fixed core diameter direction, of the space housing the coil, the length of the magnetic passage can be made sufficiently small. In order to enhance the efficiency of the magnetic passage by further reducing the length of the magnetic passage, insulating paper, an insulating sheet or an insulating resin film is provided on the nozzle pipe, and the coil is preferably wound on it directly. In the case of such constitution, generated heat of the coil is easily taken by the nozzle pipe which is cooled by the fuel, and therefore, the possibility of insulation failure, burnout and the like can be made small even if a small coil is adopted.

In the fuel injection valve in which the magnetic passage is thus designed to be short, the magnetic attraction force can be made large even with a small magnetomotive force. Specifically, the magnetic attraction force can be efficiently generated with respect to the supplied magnetomotive force. That is, when the magnetic passage is long, even if the same current is passed with the same number of windings and the same magnetomotive force is generated, the energy converted into the attraction force reduces due to the magnetic resistance of the magnetic passage itself, and the attraction force becomes small as a result. If the magnetic passage length is made short on the other hand, the energy loss is small, and therefore, a sufficient magnetic attraction force can be generated without increasing the current even if the number of windings of the coil is small (for example, the number of windings of 100 windings or less). As a result, the inductance of the coil can be reduced, the current used for drive can be rapidly raised, and responsiveness of the fuel injection valve can be enhanced. Alternatively, if the number of windings of the coil is made large (for example, the number of windings of 120 windings or larger), a large magnetic attraction force can be generated even with a small current, and power consumption can be reduced.

In the above embodiment, the example which uses the nozzle pipe of the magnetic material and is provided with the magnetism restriction at the portion corresponding to the magnetic attraction gap is described in detail, but the art to be the present invention is not limited to this embodiment.

"The art of reducing the magnetic resistance of the magnetic passage by shortening the magnetic circuit length, and increasing the magnetic flux passing the magnetic gap as much as possible with a small magnetomotive force" described above can be carried out in combination with the fuel injection valves in which the nozzle pipe is constituted of a feeble-magnetic material or a non-magnetic material, the nozzle pipe is formed by joining a non-magnetic ring to a metal pipe of a magnetic material, and the nozzle pipe is formed by partially applying non-magnetizing or feeble-magnetizing treatment to a metal pipe of a magnetic material.

The present invention can be widely used for electromagnetic valve mechanisms which operate valve bodies by driving movable plungers by electromagnetic coils, without being limited to fuel injection valves of internal combustion engines. The present invention can be used, for example, for an electromagnetic capacity control valve and an electromagnetic spill control valve (spill valve) of a fuel high-pressure pump, an electronic fuel pressure control valve or the like.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An electromagnetic fuel injection valve, comprising a valve seat, moving element having a valve body at a tip end thereof, a fixed core, and a magnetic passage, magnetic flux being supplyable to the magnetic passage including an anchor of the moving element and the fixed core by an energized ring-shaped coil such that a magnetic attraction force is generated in a magnetic attraction gap between an end surface of the anchor and an end surface of the fixed core to cause the moving element to be attracted to a fixed core side and the valve body mounted at the tip end of the moving element is separated from a valve seat to open a fuel passage, wherein the fixed core is fixed to an inside of a pipe made of a magnetic metal material, the pipe having an annular magnetism restriction portion formed on an outer circumference of the pipe at a position defined by a circumference of the magnetic attraction gap, the anchor is disposed to face the fixed core with the magnetic attraction gap therebetween, and the moving element is disposed in the pipe to be reciprocatingly movable between the valve seat and the fixed core, and wherein the annular magnetism restriction portion is a ring shaped groove;

the ring-shaped coil and a yoke which envelops upper and lower portions and a circumference of the ring-shaped coil are fitted to an outer side of the pipe, and a total inner circumference length of the magnetic passage except the magnetism restriction portion of the pipe is smaller than an outside diameter of the yoke.

2. The electromagnetic fuel injection valve according to claim 1, wherein the magnetic passage is constituted so that an axial winding width L4 of the ring-shaped coil becomes smaller than a sum of an axial dimension L3 of an upper yoke portion facing the fixed core and an axial dimension L5 of a lower yoke portion facing the anchor.

3. The electromagnetic fuel injection valve according to claim 1, wherein an axial dimension L3 of an upper yoke portion facing the fixed core, and a dimension L5 of a lower yoke portion facing the anchor become about twice as large as a thickness of the outer circumference yoke portion.

4. The electromagnetic fuel injection valve according to claim 1, wherein the magnetic passage is constituted so that a dimension L2 between an upper end of the upper yoke facing the fixed core, and a lower end of the yoke portion facing the anchor is smaller than a dimension L1 between an upper end of the spring and a lower end of the anchor.

5. The electromagnetic fuel injection valve according to claim 1, wherein in the pipe, a magnetism restriction portion is formed at a position corresponding to the magnetic attraction gap, and the magnetism restriction portion of the pipe reaches magnetic saturation earlier than the fixed core and anchor.

6. The electromagnetic fuel injection valve according to claim 1, wherein in the magnetism restriction portion comprises a non-magnetizing or feeble-magnetizing treatment portion at a position corresponding to the magnetic attraction gap.

7. An electromagnetic fuel injection valve, comprising:

a pipe made of a magnetic metal material and having an annular magnetism restriction portion formed on an outer circumference of the pipe at a position defined by a circumference of a magnetic attraction gap;

a fixed core fixed to an inside of the pipe;

a moving element facing an end portion of the fixed core with the magnetic attraction gap therebetween, and disposed to be reciprocatingly movable with respect to the fixed core inside the pipe;

a valve body which is mounted to the moving element, and opens and closes a fuel injection port;

a ring-shaped coil wound on a coil bobbin and fixed to an outer circumference of the pipe; and yokes disposed at an outer circumference and an upper and lower portions of the ring-shaped coil, wherein a magnetic passage through which magnetic flux generated by the ring-shaped coil passes is formed by the pipe, the fixed core, the moving element and the yoke, and is sized so that a coil height Hs including the coil bobbin is smaller than a sum of an axial dimension L3 of an upper yoke portion facing the fixed core and an axial dimension L5 of a lower yoke portion facing the anchor, and wherein the magnetism restriction portion is formed at a position corresponding to the magnetic attraction gap and reaches magnetic saturation earlier than the fixed core and anchor.

8. The electromagnetic fuel injection valve according claim 7, wherein an axial dimension L3 of an upper yoke portion facing the fixed core, and a dimension L5 of a lower yoke portion facing the anchor become about twice as large as a thickness of the outer circumference yoke portion.

9. The electromagnetic fuel injection valve according to claim 7, wherein the magnetic passage is constituted so that a dimension L2 between an upper end of the upper yoke facing the fixed core, and a lower end of the yoke portion facing the anchor is smaller than a dimension L1 between an upper end of the spring and a lower end of the anchor.

10. The electromagnetic fuel injection valve according to claim 7, wherein the magnetism restriction portion comprises a non-magnetizing or feeble-magnetizing treatment portion is formed at a position corresponding to the magnetic attraction gap.

11. The electromagnetic fuel injection valve according to claim 7, wherein the annular magnetism restriction portion is a ring shaped groove.

12. An electromagnetic fuel injection valve, comprising:

a pipe made of a magnetic metal material and having an annular magnetism restriction portion formed on an outer circumference of the pipe at a position defined by a circumference of a magnetic attraction gap;

a fixed core fixed to an inside of the pipe;

a moving element facing an end portion of the fixed core with the magnetic attraction gap therebetween, and disposed to be reciprocatingly movable with respect to the fixed core inside the pipe;

a valve body which is mounted to the moving element, and opens and closes a fuel injection port;

a ring-shaped coil fixed to an outer circumference of the pipe; and yokes disposed at an outer circumference and an upper and lower portions of the ring-shaped coil, wherein a magnetic passage through which magnetic flux generated by the ring-shaped coil passes is formed by the pipe, the fixed core, the moving element and the yoke and is sized so that an axial winding width L4 of the coil, an axial dimension L3 of an upper yoke portion facing the fixed core, and a dimension L5 of a lower yoke portion facing the anchor are substantially the same, and wherein the magnetism restriction portion is formed at a position corresponding to the magnetic attraction gap and reaches magnetic saturation earlier than the fixed core and anchor.

13. The electromagnetic fuel injection valve according to claim 12, wherein in the pipe, a non-magnetizing or feeble-magnetizing treatment portion is formed at a position corresponding to the magnetic attraction gap.

14. The electromagnetic fuel injection valve according to claim 12, wherein an axial dimension L3 of an upper yoke portion facing the fixed core, and a dimension L5 of a lower yoke portion facing the anchor become about twice as large as a thickness of the outer circumference yoke portion.

15. The electromagnetic fuel injection valve according to claim 12, wherein the magnetic passage is constituted so that a dimension L2 between an upper end of the upper yoke facing the fixed core, and a lower end of the yoke portion facing the anchor is smaller than a dimension L1 between an upper end of the spring and a lower end of the anchor.

16. The electromagnetic fuel injection valve according to claim 12, wherein the annular magnetism restriction portion is a ring shaped groove.

* * * * *